US005361794A

United States Patent [19]

Brady

[11] Patent Number: 5,361,794

[45] Date of Patent: Nov. 8, 1994

[54] UNITIZED FOLDABLE TENT FRAME

[76] Inventor: Rex W. Brady, 1829 Russet Dr., Eugene, Oreg. 97401

[21] Appl. No.: 927,013

[22] Filed: Aug. 10, 1992

[51] Int. Cl.[5] ..... E04H 15/48

[52] U.S. Cl. ..... 135/147; 135/154; 403/217

[58] Field of Search ..... 135/105, 102, 104, 106, 135/107, 109, 112; 403/217, 218, 117, 170

[56] References Cited

U.S. PATENT DOCUMENTS

| | | | |
|---|---|---|---|
| 14,655 | 4/1856 | Hartwell . | |
| 136,456 | 3/1873 | Peterson et al. . | |
| 1,546,222 | 7/1925 | Finlay . | |
| 1,853,367 | 4/1932 | Mace . | |
| 2,113,118 | 4/1938 | Pyatt | 135/4 |
| 3,059,658 | 10/1962 | Finlayson | 135/4 |
| 3,174,493 | 3/1965 | Gruenberg | 135/108 X |
| 3,502,091 | 3/1970 | Corbin | 135/4 |
| 3,766,932 | 10/1973 | Sidis et al. | 135/4 R |
| 3,810,482 | 5/1974 | Beavers | 135/4 R |
| 4,074,682 | 2/1978 | Yoon | 135/4 R |
| 4,280,521 | 7/1981 | Zeigler | 135/4 R |
| 4,290,244 | 9/1981 | Zeigler | 52/80 |
| 4,370,073 | 1/1983 | Ohme | 403/218 X |
| 4,393,887 | 7/1983 | Oribin | 135/109 |
| 4,590,956 | 5/1986 | Griesenbeck | 135/104 X |
| 4,607,656 | 8/1986 | Carter | 135/110 |
| 4,750,509 | 6/1988 | Kim | 135/102 |
| 4,793,725 | 12/1988 | Cheng | 403/170 X |
| 4,877,044 | 10/1989 | Cantwell et al. | 135/104 |
| 4,966,178 | 10/1990 | Eichhorn | 135/104 |
| 4,981,387 | 1/1991 | Younjae | 403/174 |
| 4,998,552 | 3/1991 | Niksie et al. | 135/102 |
| 5,253,667 | 10/1993 | Chung | 135/107 X |

*Primary Examiner*—Lanna Mai
*Attorney, Agent, or Firm*—John F. Ingman

[57] ABSTRACT

A unitized foldable tent framework includes a plurality of elongated roof members pivotally connected at their upper ends to a central hub and at their lower ends to elongated wall members. Perimetric interconnection of the roof members, in the form of a line which may be elastic, extends around the pivotal connections between the roof and wall members to form a loop whose perimeter length increases and decreases so as to expand and contract the separation between the lower ends of adjacent roof members. Elongated tubular eave members, formed in connectable sections, concentrically enclose the perimetric interconnection between adjacent roof members, with the eave members also being pivotally connected to the pivotal connection between the roof and wall members. Wall members extending downward from adjacent pivotal connections are flexibly joined at their lower ends in pairs. The pivotal connection of the elongated roof, wall, and eave members includes a hub member and a hub lock member, each having a plurality of U-shaped openings about its perimeter, which are connected so as to rotate about a common central axis. The U-shaped openings are aligned to allow the elongated members to pivot unimpeded at their connection to the hub member; when the hub lock member is rotated, its U-shaped openings are replaced by projections which restrain the elongated members from pivotal movement. The projections of the hub lock member may include a radial groove and beveled lateral surfaces.

19 Claims, 4 Drawing Sheets

UNITIZED FOLDABLE TENT FRAME

BACKGROUND OF THE INVENTION

1. Field of the Invention

This invention involves a foldable tent frame, and, more particularly, a unitized foldable tent framework which readily may be raised and lowered by one person.

2. Description of the Prior Art

Numerous frameworks for tents have previously been designed. U.S. Pat. No. 1,546,222 discloses a tent framework in the form of a truncated icosahedron, the frame not being expandable or collapsible but rather being designed to be put together one piece at a time. U.S. Pat. No. 3,059,658 discloses a collapsible framework wherein the procedure for setting up the framework is time-consuming, needs more than one person, and precludes the tenting from being permanently attached to the frame. U.S. Pat. No. 3,502,091 discloses a tent frame, also in the form of a truncated icosahedron, wherein the inventor has eliminated nine of the twenty poles by replacing them with cables. This design includes assembly of loose pieces and therefore is not a true unitized, collapsible design. U.S. Pat. No. 3,766,932 discloses a truncated icosahedron without the five perimeter eave poles. One leg has been removed out of adjacent pairs of triangles to create diamonds, permitting the structure to fold, with no attempt being made to shore up the ensuing structural voids. U.S. Pat. No. 4,393,887 discloses a collapsible tent frame wherein perimeter eave poles utilize a hinged connection, as generally do base members, in the form of a solid vertex hinge which includes a plate to which ends of elongated members are pivotally connected, as by a pin-type pivot, without locking.

Some earlier designs of foldable tent frames, such as disclosed in U.S. Pat. No. 3,766,932, incorporate a hub lock member to join the various poles. U.S. Pat. No. 4,966,178 discloses a more complex locking hub which utilizes an internal spring to engage the lock, while in U.S. Pat. No. 4,998,552 pivotal motion of the poles is checked by a hub through rotational movement of the poles.

It is an objective of this invention to provide a foldable tent framework of unitized construction, that is, without separate parts, which can be readily raised and lowered by one person.

It also is an objective of this invention to provide a design for a foldable tent framework of unitized construction which may be used with a variety of tent shapes and sizes, to include larger family sized tents as well as simple canopy arrangements.

It also is an objective of this invention to provide a means for temporarily retaining a unitized folding tent framework in a raised position so that one person, in raising a tent, may structurally secure the framework about its perimeter without assistance.

It specifically is an objective of this invention to provide a foldable family size tent framework of unitized construction which is easily carried in a station wagon or pickup and which can be readily raised and lowered by one person.

It also is an objective of this invention to provide a locking perimeter hub, for joining elongated tent frame members of the unitized foldable tent frame at a common pivot point, which is simple, relatively inexpensive and easy to operate by one person.

SUMMARY OF THE INVENTION

The present invention provides a unitized foldable tent frame which is designed to satisfy the aforementioned objectives. The invention includes a flexible perimetric interconnection of elongated roof members which permits expansion and contraction of spacing between adjacent roof members during raising and lowering operations with the tent frame. The perimetric interconnection being enclosed within tubular eave members.

Accordingly, the invention, in a preferred embodiment, involves a completely unitized, foldable framework to support a tent or canopy. The framework includes a plurality of elongated roof members pivotally connected at their upper ends to a central hub and at their lower ends to elongated wall members. Perimetric interconnection of the elongated roof members may include a line continuously extending around the pivotal connections between the roof and wall members to form a loop whose perimeter length may be increased and decreased so as to expand and contract the separation between the lower ends of adjacent elongated roof members. The line may be of continuous elastic or may involve a plurality of elastic line segments, each extending between a pair of adjacent elongated roof members.

A plurality of elongated tubular eave members concentrically enclose the perimetric interconnection between adjacent elongated roof members, with the elongated tubular eave members also being pivotally connected to the pivotal connection between the roof and wall members. Such elongated tubular eave members are separable into multiple, preferably two, sections which, with the framework temporarily held in a raised position by perimetric interconnection, are connectable to form a continuous tubular eave member between adjacent elongated roof members.

While a single elongated wall member may be pivotally attached to each roof member, it is preferred that there be twice the number of wall members as roof members, with two wall members extending divergently downwards from each pivotal connection with a roof member. The wall members extending downward from adjacent pivotal connections are flexibly joined at their lower ends in pairs, with a flexible joinder, such as a flexible cylindrical rubber section attached between the lower ends of the wall members.

A preferred tent framework includes five elongated roof members, five elongated tubular eave members enclosing the perimetric interconnection, and ten elongated wall members, all of which are combined in the general form of a truncated icosahedron.

The elongated roof members, elongated tubular eave members, and elongated wall members may either be resiliently flexible or rigid in construction. Where these members are resiliently flexible, the means of pivotally interconnecting them at a pivotal connection preferably involves a perimeter hub which includes a hub member having a plurality of pivot locations, in the form of U-shaped openings, about its perimeter, and a hub lock member which is connected to the hub member so as to rotate about a common central axis. The hub lock member has a corresponding plurality of U-shaped openings, which, when aligned with the U-shaped openings of the hub member, allow the elongated members to rotate unimpeded at their pivotal connection to the hub member. However, when said hub lock member is rotated so as to shift its U-shaped openings out of alignment with the U-shaped openings of the hub member, the hub lock member restrains, by means of projections adjacent to and separating its U-shaped openings, the elongated members from complete pivotal movement. The hub lock member preferably includes a radial groove formed in its projections, so as to notchingly engage the elongated members. Beveled surfaces on the projections and adjacent to the U-shaped openings of the hub lock member reduce the rotational force necessary to place the hub lock member in a locked position.

When resiliently flexible elongated members are used, the resilient pressure of the bent elongated members, when the hub lock member is rotated to the locked position, retains the elongated member in the engaging radial grooves. When rigid elongated members are used, the projections of the hub lock member may be formed to be resilient themselves, so that the resilient pressure of the bent projections of the hub lock member against the rigid elongated members serves to retain the elongated members within the radial grooves of the projections.

DETAILED DESCRIPTION OF THE INVENTION

Turning now to the drawings, there is shown, in FIGS. 1 through 5, a unitized foldable tent frame 10 as it progresses through a sequence of unfolding and being raised. In these figures, a preferred configuration of a tent frame in the form of a truncated icosahedron employing flexible, resilient elongated frame members is shown; however, the inventive aspects are applicable to a variety of sizes and shapes of tent and canopy frames, including those utilizing stiff, rigid frame members, as will be subsequently appreciated.

Figure 1:
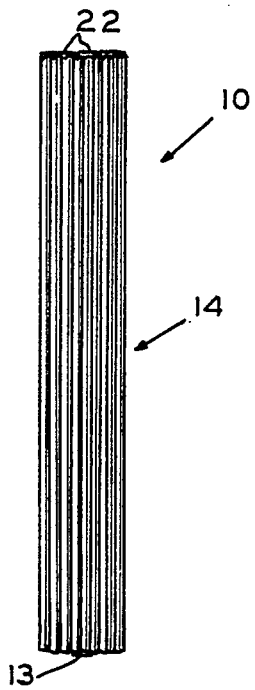
FIG. 1 illustrates the unitized foldable tent frame in a folded configuration for transport and storage.
Figure 2:
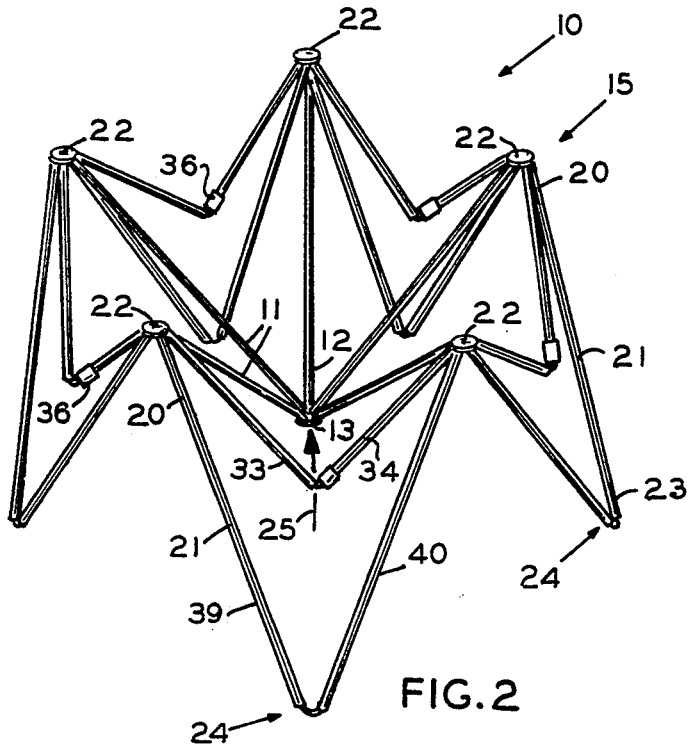
FIG. 2 illustrates the unitized foldable tent frame in an early stage of the tent erection process where the wall members have been moved outwardly.
Figure 3:
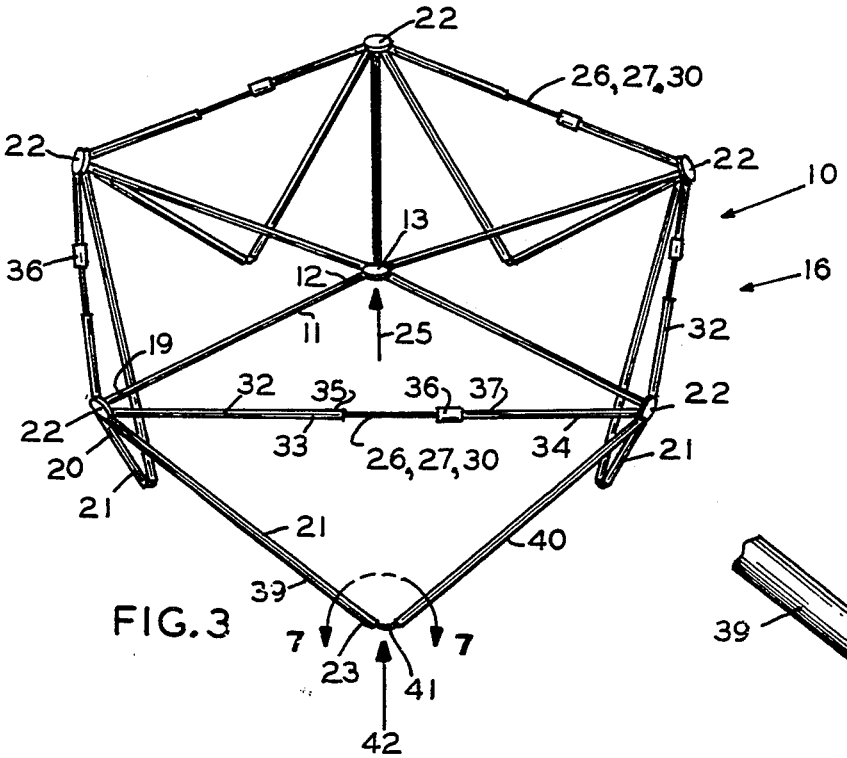
FIG. 3 illustrates the unitized foldable tent frame in a stage of tent erection wherein the roof members have been raised from their position in FIG. 2 to a horizontal, planar position.
Figure 7:
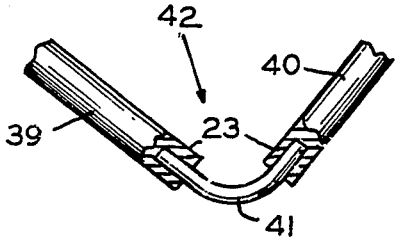
FIG. 7 illustrates a means of flexibly connecting the lower ends of adjacent elongated wall members.
Figure 4:
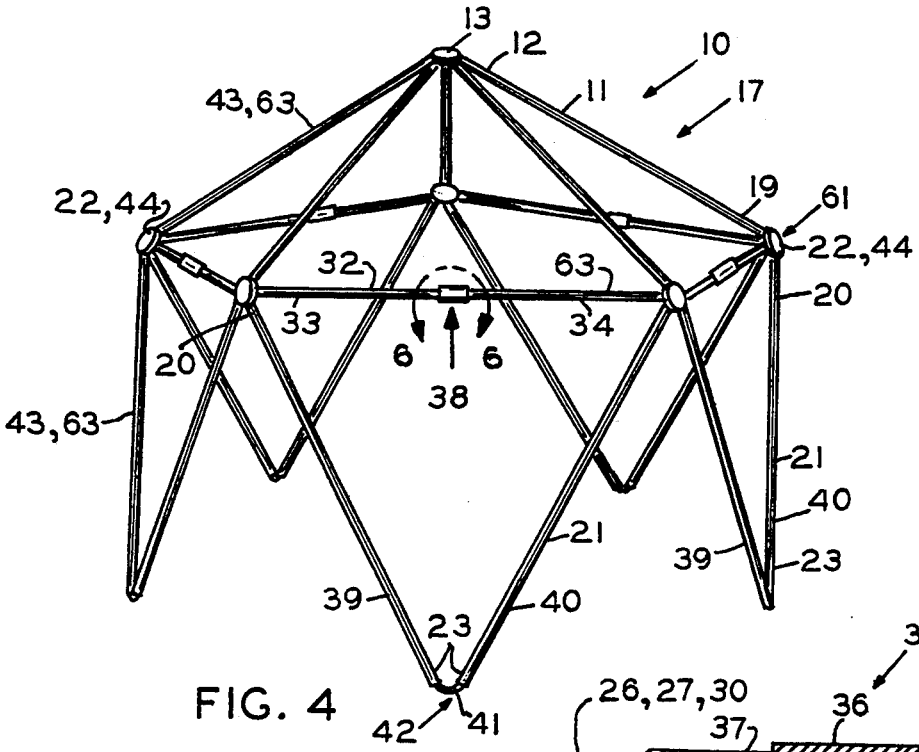
FIG. 4 illustrates the unitized foldable tent frame in a final raised configuration for rigid frame members or a penultimate configuration for flexible, resilient frame members.
Figure 5:
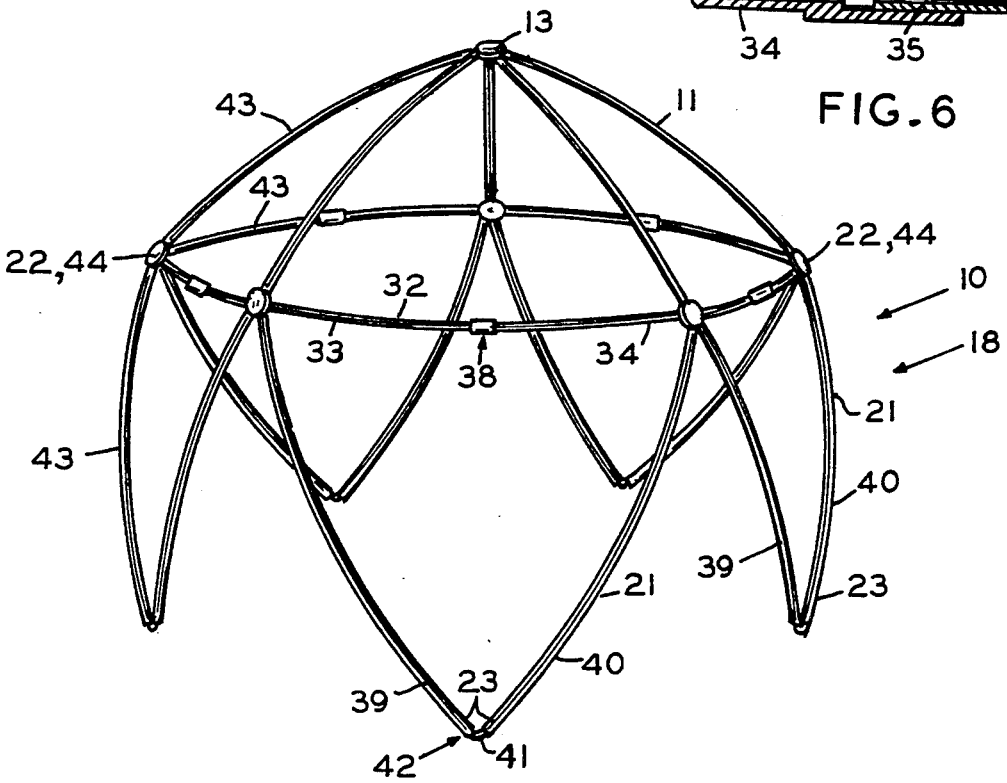
FIG. 5 illustrates the unitized foldable tent frame in a final raised configuration for flexible, resilient frame members.
Figure 8:
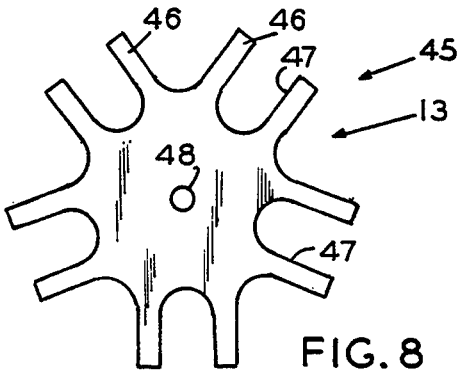
FIG. 8 illustrates a top plan view of the hub member of the perimetric hub of the unitized foldable tent frame.
Figure 10:
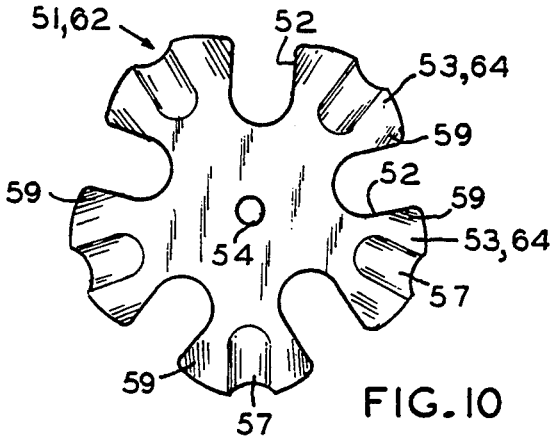
FIG. 10 illustrates a top plan view of the hub lock member of the perimetric hub of the unitized foldable tent frame.
Figure 9:
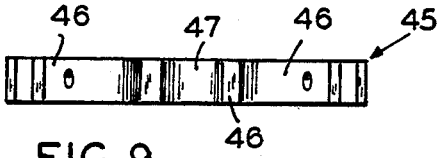
FIG. 9 illustrates a side view of the hub member of FIG. 8.
Figure 11:
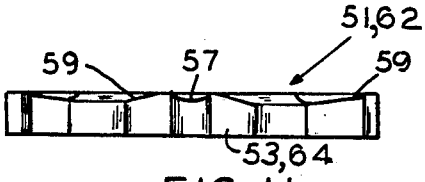
FIG. 11 illustrates a side view of the hub lock member of FIG. 10.

Thus, as illustrated, the unitized foldable tent frame 10 includes a plurality of elongated roof members 11, five as illustrated, each having an upper end 12 pivotally joined at a common location by a central hub 13. The pivotal movement of the elongated roof members 11 at the central hub 13 includes rotation from the folded position 14, as seen at FIG. 1 where the roof members 11 are substantially parallel; through intermediate position 15 as seen at FIG. 2; through intermediate position 16 as seen at FIG. 3, whereat the roof members 11 essentially form a plane by radially extending from the central hub 13; through a raised position 17 as seen at FIG. 4; to the final raised and locked position 18 as seen in FIG. 5. The central hub 13 may be formed like the hub member 45 portion of the perimetric hub 44, subsequently discussed, the hub member 45 design allowing the full rotation by the pivotally attached roof members 11 which is required for the central hub 13.

As viewed with the tent frame 10 raised, the lower end 19 of each roof member 11 is pivotally connected to an upper end 20 of at least one elongated wall member 21, where the perimeter pivotal connection 22 may range in construction from a simple hinge (not shown) to the locking perimeter hub 44 subsequently described. The range of rotation of perimeter pivotal connection 22 varies from the roof member 11 and wall member 21 being substantially parallel in the folded position 14 of FIG. 1, through the intermediate positions 15 and 16 of FIGS. 2 and 3, respectfully, to the raised positions 17 and 18 of FIGS. 4 and 5. It is desirable that the perimeter pivotal connection 22 be capable of being locked when in the raised position 17 to provide structural stability.

With the roof members 11 and wall members 21 pivotally joined as described, the unitized foldable tent frame 10 may be collapsed into a compact folded position 14 as seen at FIG. 1, which allows the unitized foldable tent frame 10 to be conveniently stored and transported. Initially, the individual tent raiser would laterally extend the lower end 23 of the wall members 21 outwardly, as seen in FIG. 2, to approximately their final position 24 upon the ground, where the lower ends 23 of the wall members 21 are restrained to prevent inadvertent movement during the raising process. Next, the roof members 11 are progressively raised, as by upward pressure 25 at the central hub 13, through intermediate position 16 where the roof members 11 are essentially planar in their radial extension from the central hub 13 as shown at FIG. 3, to the fully raised position 17 of FIG. 4. In the fully raised position 17, if the relative position of the roof members 11 could be maintained, the foldable tent frame 10 would remain erect. While it may be possible to maintain the relative position of the roof members 11 by locking their pivotal movement at the central hub 13, such locking would be difficult to accomplish because of the normally elevated height of central hub 13 in the fully raised position 17. A second alternative is to lock the pivotal movement at the perimeter pivotal connections 22 about the perimeter of the foldable tent frame 10. However, it would be extremely difficult, if not impossible, for one individual to physically hold central hub 13 in the raised position while at the same time locking the perimeter pivotal connections 22. A third alternative, and a part of the present invention, additionally involves a perimetric interconnection 26 of the roof members 11 which, at least temporarily, retains the tent frame 10 in a raised position 17 by retaining the relative spacing between the lower ends 19 of adjacent roof members 11, while the individual user proceeds to lock the perimeter pivotal connections 22.

Figure 19:
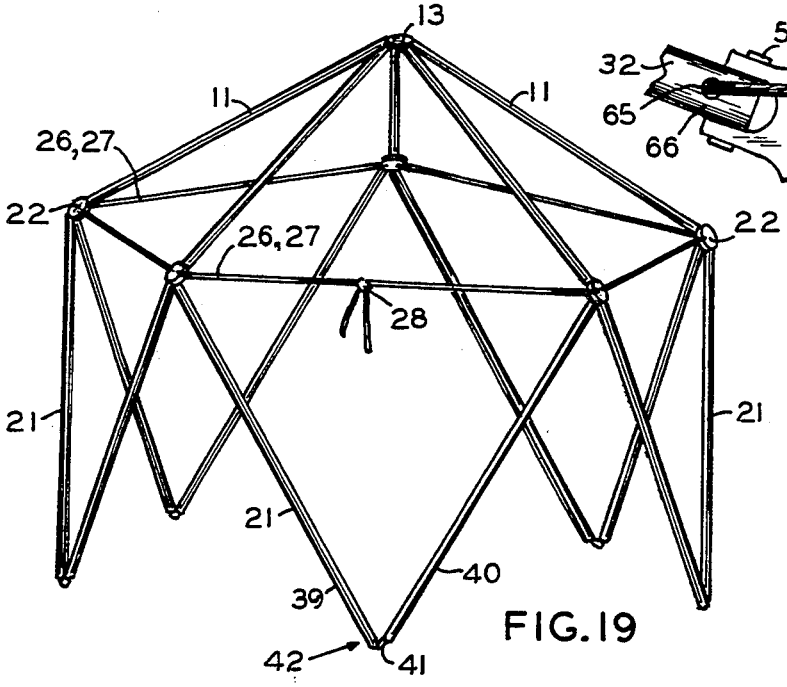
FIG. 19 illustrates a unitized foldable tent frame in a raised position, corresponding to the position of FIG. 4, but without the use of elongated tubular eave members.

Such means of perimetric interconnection 26 may include a line 27, such as a cord, rope, wire, chain, or string, which continuously extends about the perimeter of the raised tent frame 10 so as to form a loop whose perimeter length may be varied as required. A preferred location of the line 27 is around the pivotal connections 22 between the roof members 11 and wall members 21. Upon elevating the central hub 13 to the raised position 17, the line 27 could then be tightened at its raised position 17 perimeter length thereby supporting the foldable tent frame 10 in that position 17. This is best seen at FIG. 19 where the foldable tent frame 10 is shown in the raised position 17, as held by line 27 without the use of the subsequently discussed elongated tubular eave members 32. It should be noted that, once beyond the intermediate position 16, the individual may be able to continue the raising motion by simply reducing the perimeter length of the line 27, thereby pulling the perimeter connections 22 closer together which causes the central hub 13 to continue to rise. Upon reaching the raised position 17, the line 27 may be tied off as seen at 28, to retain its length thereat, so that the individual tent raiser then is free to proceed to further stabilize the temporarily raised foldable tent frame 10.

The line 27, in forming a perimetric interconnection 26, may be elastic, so that it is capable of expanding and contracting uniformly along its perimeter length. Thus, instead of the individual tent raiser needing to tie off as at 28 (FIG. 19) the line 27 at the desired perimeter length, an elastic line 30 would be capable, without further adjustment, of expanding as the central hub 13 was raised through the intermediate position 16 (FIG. 3) where the roof members 11 are coplanar, and the perimeter length of the line 27, 30 is at a maximum, and then contracting to the perimeter length where the central hub 13 remains elevated in the raised position 17. The elastic line 30 between the roof members 12, may either be continuous or formed in segments connected between each pair of adjacent roof members 12.

Once retained in a raised position 17 by a perimetric interconnection 26, additional stabilization would be performed by the tent raiser. This would normally include the locking of the pivotal connections 22 between the roof members 11 and the wall members 21. A preferred perimeter hub 44 with a locking capability is discussed subsequently.

Figure 6:
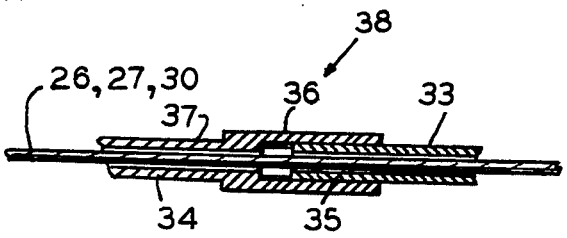
FIG. 6 illustrates a means of connection of the elongated tubular eave member sections enclosing the perimetric interconnection of the invention.

Another important means of providing tent stability, where a means of perimetric interconnection 26, as described above, is utilized, is by the use of a plurality of elongated tubular eave members 32 which concentrically enclose the perimetric interconnections 26, between adjacent roof members 12. The tubular eave members 32, are pivotally connected to, and extend horizontally between, the pivotal connections 22 joining the roof members 11 and wall members 21. For purposes of folding and expansion, the elongated tubular eave members 32 are separable into multiple, preferably two, eave member sections 33 and 34, which are reconnected into a single continuous tubular eave member 32 when the folding tent frame 10 is in the raised position 17. The need for complete separation of the tubular eave members 32 into eave member sections 33 and 34, can be seen in the comparing the folded position 14 of FIG. 1 where the eave member sections 33, 34, as retained by the perimetric interconnection 26 threaded therethrough, would be substantially parallel, to the intermediate position 16, as seen in FIG. 3, where their inner ends 35 and 37 would be physically separated since the required lengthening or expansion of the perimetric interconnection 26 at position 16 produces a perimeter length which is greater than the total length of the tubular eave members 32. In the raised position 17, where the perimeter length of the perimetric interconnection 26 is once again reduced, the inner ends 35, 37 of the eave member sections 33, 34 return to substantially abut, allowing reconnection into a continuous tubular eave member 32. Such connection 38 between tubular eave member sections 33 and 34 may be accomplished in a variety of ways, a simple and effective manner being a connection where the end 35 of one eave member section 33 frictionally fits tightly within a ferrule 36 molded with or attached to end 37 of the adjacent eave member section 34, as better seen in FIG. 6. When eave members 32 are utilized, the next step, once the tent frame 10 is retained in a raised position 17 by the perimetric interconnection 26, would be to connect the eave member sections 33 and 34 to form the complete tubular eave members 32, to be followed by the locking of the pivotal connections 22.

While the foldable tent frame 10, as described above, will have at least one wall member 21, extending downward from, and connected to, its pivotal connection 22 to each roof member 11, the preferred embodiment, as best seen in FIGS. 4 and 5, which provides a sturdier configuration, utilizes two elongated wall members 39 and 40 which are pivotally attached, at their upper ends 20, to the lower end 19 of each roof member 11 and extend divergently downward therefrom. The wall members 39 may be pivotally joined, in pairs, to the corresponding wall members 40 pivotally connected to adjacent roof members 12, at their lower ends 23. The preferred means of pivotal joinder 42 of the lower ends 23 of adjacent wall members 39, 40 provides flexible pivotal interconnection by means of a segment of flexible material, such as a cylindrical rubber section 41, attached between the lower ends 23, such joinder 42 providing the desired variability in position of the connected wall members 39, 40, particularly when leaving or approaching the folded position 14. It may be desirable not to join, but rather to leave spaced apart one pair of lower ends 23, so as to more readily provide an entrance opening to within the folding tent frame 10 and attached tent (not shown).

The preferred embodiment for the unitized foldable tent frame 10, especially for a family general purpose tent, is in the form of a truncated icosahedron, having five roof members 11, five tubular eave members 32, and ten wall members 39, 40. Variations in site and use, however, may make the use of a truncated shape having four roof members 11, four tubular eave members 32, and eight wall members 39, 40, desirable. Other similar configurations utilizing two wall members for each roof member, also may be used.

In these forms of the preferred embodiment, each perimetric pivotal connection 22 generally will involve the pivotal attachment of five elongated members 43, that is, one roof member 11, two tubular eave members 32, and two wall members 39, 40. Although other forms of perimetric pivotal connection 22 may be used, the preferred form is a perimeter hub 44 which includes a hub member 45, in disk-like shape having a plurality of projections 46, ten in the preferred unitized foldable tent frame 10 embodiments, which form radial U-shaped openings 47 equiangularly disposed about its perimeter and extending inwardly towards its center 48. Within the radial U-shaped openings 47, the ends 49 of the elongated members 43 are pivotally attached, as by pivots 50, so as to be rotatable within the U-shaped opening 47. A hub lock member 51, of comparable size and shape to the hub member 45, also has a plurality, five in the preferred embodiments, of radial U-shaped openings 52 corresponding in size and angular location to the radial U-shaped openings 47 of the hub member 45. Between adjacent radial U-shaped openings 52 of hub lock member 51, projections 53 extend radially outward.

Figure 12:
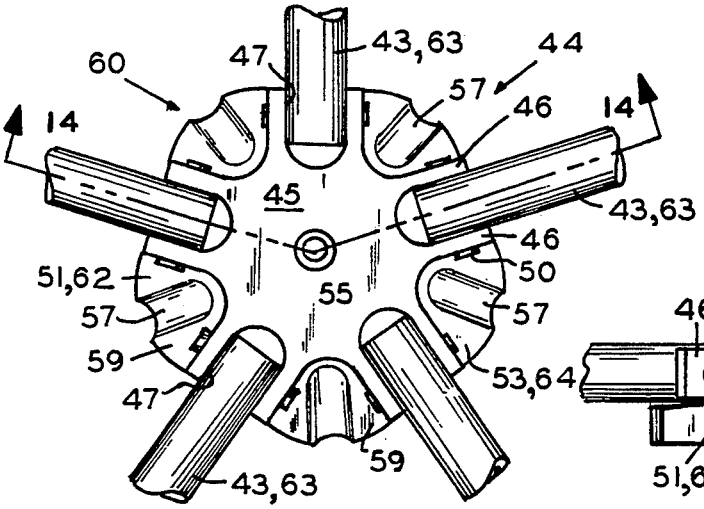
FIG. 12 illustrates a top view of the assembled perimetric hub in an unlocked position.
Figure 13:
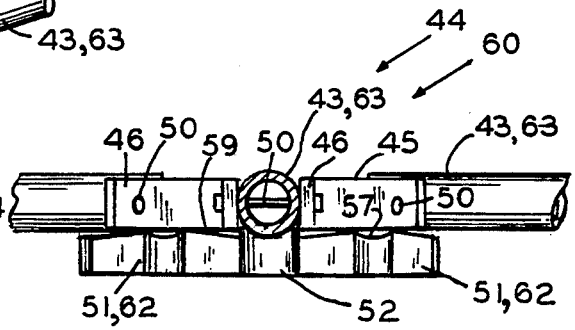
FIG. 13 illustrates a side view of the perimetric hub of FIG. 12.
Figure 14:
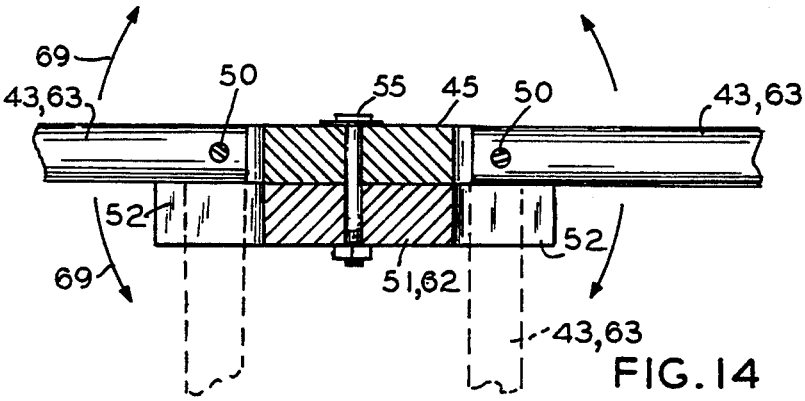
FIG. 14 illustrates a cross sectional view, as seen at line 14—14 of FIG. 12, showing the range of movement of the attached elongated frame members with the perimeter hub in the unlocked position.
Figure 15:
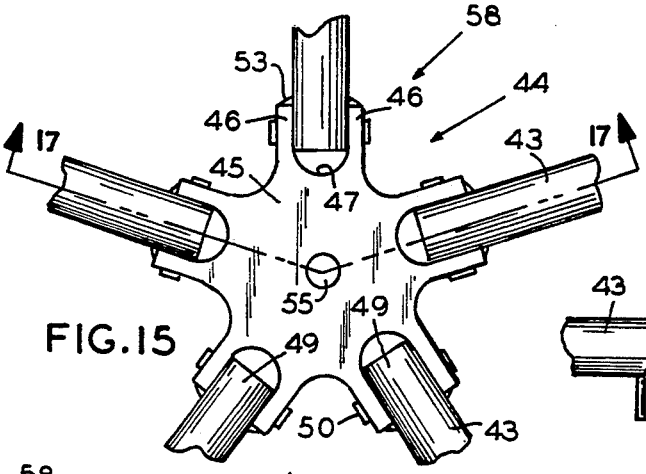
FIG. 15 illustrates a top view of the assembled perimetric hub in a locked position.
Figure 16:
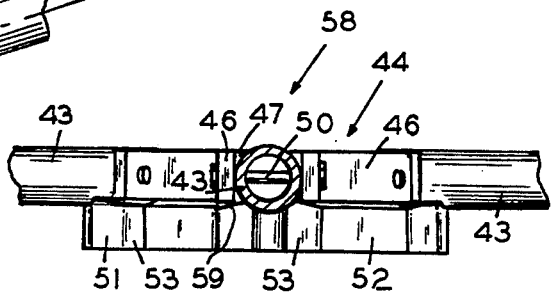
FIG. 16 illustrates a side view of the perimetric hub of FIG. 15.
Figure 17:
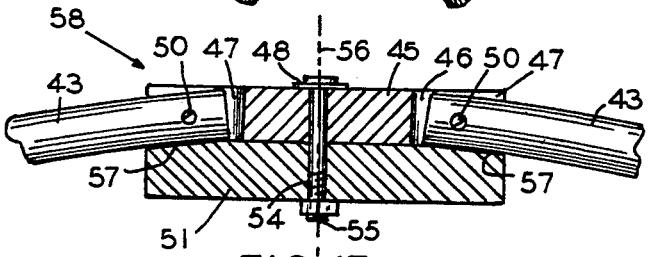
FIG. 17 illustrates a cross-sectional view, as seen at line 17—17 of FIG. 15 showing the position of flexible, resilient elongated members in the locked perimetric hub.
Figure 18:
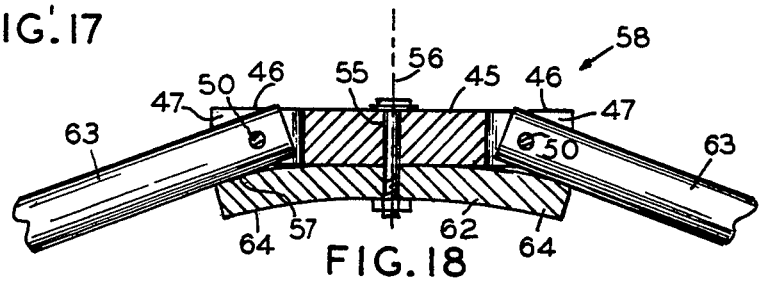
FIG. 18 illustrates a cross-sectional view corresponding to FIG. 17 but with rigid elongated members in an alternative configuration of perimetric hub having resilient locking hub projections.

The hub member 45 and hub lock member 51 are adjacently and rotatingly connected at their respective centers 48 and 54, as by pivot 55, so as to permit rotation about common axis 56 within parallel planes. Thus, when the hub lock member 51 is rotated so as to align its radial U-shaped openings 52 with the radial U-shaped openings 47 of the hub member 45, as seen in FIGS. 12–14, the perimeter hub 44 is in an unlocked position 60, with the elongated members 43 having unimpeded rotational capability upon the hub member 45, as seen at 69 in FIG. 14. However, when the hub lock member 51 is rotated about axis 56 so that its projections 53 coincide with the radial U-shaped openings 47 of the hub member 45, as seen in FIGS. 15–17, the elongated members 43 cannot pivot through the projections 53 and thus are denied rotation. The hub-lock member 51 may have radial grooves 57 formed upon the projections 53 to detentingly engage the elongated members 43 in a locked position 58, and may also have bevelled surfaces 59 adjacent to its U-shaped openings 52 so as to make easier the initial rotation of the hub lock member 51 from the unlocked position 60 to the locked position 58.

In general, the elongated members 43 may be formed of a resiliently flexible material, such as nylon or glass fiber, or of a more rigid material, such as aluminum. When the elongated members 43 are formed of a resiliently flexible material, and with the foldable tent frame 10 in the raised position 17, the individual tent raiser may apply external pressure 61 directly upon the perimeter hub 44 (see FIG. 4), against the resilient pressure of the elongated members 43 (roof member 11, wall members 39, 40, and eave members 32), to a position where the elongated members 43 are sufficiently bent to become substantially coplanar, whereat the hub lock member 51 may be rotated so as to shift its radial U-shaped openings 52 out of alignment with the radial U-shaped openings 47 of the hub member 45 and substitute therefor its projections 53. When the pressure 61 is released, the resilient pressure from the bent resiliently flexible elongated members 43 will cause the elongated members 43 to press into the radial grooves 57 in the projections 53 of the hub lock member 51, thereby both preventing further pivotal movement of the elongated members 43 and also restricting further rotational movement between the hub member 45 and the hub lock member 51.

However, where the elongated members 43 are not resiliently flexible but rather are rigid, it will not be possible to apply sufficient pressure 61 upon the hub member 45 to bend the elongated members 43 to substantially a coplanar position. Thus, in the hub lock member 62, which is designed to be used with rigid elongated members 63, the projections 64 of the hub lock member 62 themselves are resiliently flexible, so that pivoting of the rigid elongated members 63 within the hub member 45 will be limited by the resilient resistance of the projections 64 of the hub lock member 62. The resilient projections 64 of the hub lock member 62 also having radial grooves 57, the pressure exerted by the resilient projections 64 in the locked position 58 against the rigid elongated members 63 both blocks further pivotal movement of the elongated members 63 and restricts further rotational movement between the hub member 45 and the hub lock member 62. FIG. 4 additionally illustrates the form of the unitized foldable tent frame 10, in a locked raised position 17 when formed of rigid elongated members 63 and utilizing a perimeter hub 44 having the hub lock 62 with resilient projections 64.

Figure 20:
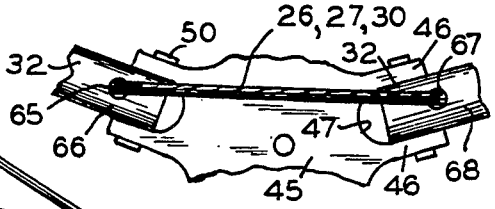
FIG. 20 illustrates a means for attaching the perimetric interconnection at the perimetric hub of the preferred embodiment.

The perimetric interconnection 26 may be attached to the perimeter connections 22 by various manners. FIG. 20 illustrates a means of attachment of the perimetric interconnection 26 in the form of a continuous line 27, 30 wherein, being enclosed within the elongated tubular eave member 32, the line 27, 30 exits through an aperture 65 formed near an outer end 66 thereof, crosses the hub member 45, and re-enters another elongated tubular eave member 32 at a corresponding aperture 67 formed at its outer end 68.

It is thought that the foldable tent frame 10 of the present invention and its many attendant advantages will be understood from the foregoing description and that it will be apparent that various changes in form, construction and arrangement of the parts thereof may be made without departing from the spirit and scope of the invention or sacrificing all of its material advantages, the form hereinbefore described being merely an exemplary embodiment thereof.

I claim:

1. A foldable tent framework comprising:

a. a plurality of elongated roof members, each elongated roof member having an upper end and a lower end;

b. a plurality of elongated wall members, each elongated wall member having an upper end and a lower end;

c. means for pivotally connecting the upper ends of the plurality of elongated roof members at a central location;

d. a plurality of elongated eave members which are formed in connectable sections; and e. means for pivotally connecting the lower end of each elongated roof member, the upper end of at least one elongated wall member, and one end of two elongated eave members, which include a perimetric hub comprising:

(1) a hub member, having a center and a perimeter, which includes a plurality of U-shaped openings about said perimeter which pivotally receive said elongated roof, wall, and eave members;

(2) a hub lock member, having a center and a perimeter, which includes a plurality of U-shaped openings formed about said perimeter and a plurality of projections which extend radially between said U-shaped openings of said hub lock member;

(3) said hub member and said hub lock member being rotatably connected at their respective centers, so as to rotate about a common axis;

(4) said hub member and said hub lock member being formed so that when the U-shaped openings of said hub member are aligned with the U-shaped openings of said hub lock member, said elongated roof, wall, and eave members are capable of pivotal movement, and when the hub lock member is rotated relative to said hub member so that the U-shaped openings of said hub member are aligned with said projections of said hub lock member, said elongated roof, wall, and eave members engage said projections and are restrained thereby from substantial pivotal movement;

(5) said projections of said hub lock member each having a radial groove forming a detent surface in said projection which engages said elongated roof, wall, and eave members.

2. A foldable tent framework comprising:

a. a plurality of elongated roof members, each elongated roof member having an upper end and a lower end;

b. a plurality of elongated wall members, each elongated wall member having an upper end and a lower end;

c. means for pivotally connecting the upper ends of the plurality of elongated roof members at a central location;

d. means for pivotally connecting the lower end of each elongated roof member to the upper end of at least one elongated wall member, which include:

(1) a hub member, having a center and a perimeter, which includes a plurality of U-shaped openings about said perimeter which pivotally receive said elongated roof and wall members;

(2) a hub lock member, having a center and a perimeter, which includes:

(a) a plurality of U-shaped openings formed about said perimeter; and (b) a plurality of projections which extend radially between said U-shaped openings of said hub lock member;

(3) said hub member and said hub lock member being rotatably connected at their respective centers, so as to rotate about a common axis;

(4) said hub member and said hub lock member being formed so that when the U-shaped openings of said hub member are aligned with the U-shaped openings of said hub lock member, said elongated roof and wall members are capable of pivotal movement, and when the hub lock member is rotated relative to said hub member so that the U-shaped openings of said hub member are aligned with said projections of said hub lock member, said elongated roof and wall members engage said projections and are restrained thereby from substantial pivotal movement; and e. means of perimetric interconnection of said plurality of centrally connected elongated roof members, which means of perimetric interconnection are formed to permit expansion and contraction of separation between the lower ends of adjacent elongated roof members.

3. The foldable tent framework, as recited in claim 2, wherein said projections of said hub lock member each have a radial groove forming a detent surface in said projection which engages said elongated roof and wall members in a locked position.

4. The foldable tent framework, as recited in claim 3, wherein said projections of said hub lock member each have beveled lateral surfaces adjacent to said U-shaped openings which are formed so that said elongated roof and wall members engage said beveled lateral surfaces as said hub lock member is rotated toward said locked position.

5. The foldable tent framework, as recited in claim 2, wherein said means of perimetric interconnection of said plurality of elongated roof members include a line continuously extending between said means for pivotally connecting said lower end of each elongated roof member to said upper end of said elongated wall member, thereby forming a loop whose length is capable of increasing and decreasing to expand and contract the separation between the lower ends of adjacent elongated roof members.

6. The foldable tent framework, as recited in claim 5, wherein said line is elastic.

7. The foldable tent framework, as recited in claim 2, wherein said perimetric interconnection of said plurality of elongated roof members includes an elastic line segment extending between adjacent means for pivotally connecting said lower end of each elongated roof member to said upper end of said elongated wall member.

8. The foldable tent framework, as recited in claim 2, wherein, additionally, there are a plurality of elongated tubular eave members which concentrically enclose said means of perimetric interconnection between adjacent elongated roof members; said tubular eave members also being pivotally connected to said means for pivotally connecting said lower end of said elongated roof member to said upper end of at least one elongated wall member; each said elongated tubular eave member being formed in sections which are connectable to form a continuous tubular eave member between adjacent elongated roof members.

9. The foldable tent framework, as recited in claim 8, being formed, in a raised position, as a truncated icosahedron, having five elongated roof members, five elongated eave members, and ten elongated wall members.

10. The foldable tent framework, as recited in claim 2, wherein there are twice the number of elongated wall members as elongated roof members, two elongated wall members extending from each means for pivotally connecting the lower end of each elongated roof member to the upper end of at least one elongated wall member.

11. The foldable tent framework, as recited in claim 10, wherein said elongated wall members, extending from adjacent means for pivotally connecting said elongated roof member to said elongated wall members, are flexibly joined in pairs at said lower ends of said elongated wall members.

12. The foldable tent framework, as recited in claim 11 wherein said flexible joinder includes a segment of flexible material attached between said lower ends of said elongated wall members.

13. A foldable tent framework comprising:

a. a plurality of elongated roof members, each elongated roof member having an upper end and a lower end;

b. a plurality of elongated wall members, each elongated wall member having an upper end and a lower end;

c. means for pivotally connecting the upper ends of the plurality of elongated roof members at a central location;

d. means for pivotally connecting the lower end of each elongated roof member to the upper end of at least one elongated wall member;

e. means of perimetric interconnection of said plurality of centrally connected elongated roof members, which means of perimetric interconnection are formed to have a perimetric length which is readily alterable by a tent-raising individual to variably control the position of, and separation between, the lower ends of adjacent elongated roof members during tent raising; and f. a plurality of elongated tubular eave members which concentrically enclose said means of perimetric interconnection between adjacent elongated roof members; said tubular eave members also being pivotally connected to said means for pivotally connecting said lower end of said elongated roof member to said upper end of at least one elongated wall member; each said elongated tubular eave member being formed in sections which are connectable to form a continuous tubular eave member between adjacent elongated roof members.

14. The foldable tent framework, as recited in claim 13, wherein said means of perimetric interconnection of said plurality of elongated roof members include a line continuously extending between said means for pivotally connecting said lower end of each elongated roof member to said upper end of said elongated wall member, said line thereby forming a continuous loop whose length is readily alterable by a tent-raising individual to variably control the position of, and separation between, the lower ends of adjacent elongated roof members during tent raising.

15. The foldable tent framework, as recited in claim 14, wherein said continuously extending line is elastic.

16. The foldable tent framework, as recited in claim 13, wherein said means of perimetric interconnection of said plurality of elongated roof members includes a plurality of separate elastic line segments extending between adjacent means for pivotally connecting said lower end of each elongated roof member to said upper end of said elongated wall member.

17. The foldable tent framework, as recited in claim 13, wherein there are twice the number of elongated wall members as elongated roof members, two elongated wall members extending from each means for pivotally connecting the lower end of each elongated roof member to the upper end of at least one elongated wall member.

18. The foldable tent framework, as recited in claim 13, wherein said elongated wall members, extending from adjacent means for pivotally connecting said elongated roof member to said elongated wall members, are flexibly joined in pairs at said lower ends of said elongated wall members.

19. A foldable tent framework comprising:

a. a plurality of elongated roof members, each elongated roof member having an upper end and a lower end;

b. a plurality of elongated wall members, each elongated wall member having an upper end and a lower end;

c. means for pivotally connecting the upper ends of the plurality of elongated roof members at a central location;

d. means for pivotally connecting the lower end of each elongated roof member to the upper end of at least one elongated wall member;

e. means of perimetric interconnection of said plurality of centrally connected elongated roof members, which means of perimetric interconnection are formed to have a perimetric length which is readily alterable by a tent-raising individual to variably control the position of, and separation between, the lower ends of adjacent elongated roof members during tent raising; and f. a plurality of elongated tubular eave members which concentrically enclose said means of perimetric interconnection between adjacent elongated roof members; said tubular eave members also being pivotally connected to said means for pivotally connecting said lower end of said elongated roof member to said upper end of at least one elongated wall member; each said elongated tubular eave member being formed in sections which are connectable to form a continuous tubular eave member between adjacent elongated roof members;

g. said foldable tent framework being formed, in a raised position, as a truncated icosahedron, having five elongated roof members, five elongated eave members, and ten elongated wall members.

* * * * *